US006318469B1

(12) United States Patent
Patel

(10) Patent No.: US 6,318,469 B1
(45) Date of Patent: Nov. 20, 2001

(54) COMPLETION EQUIPMENT HAVING A PLURALITY OF FLUID PATHS FOR USE IN A WELL

(75) Inventor: Dinesh R. Patel, Sugar Land, TX (US)

(73) Assignee: Schlumberger Technology Corp., Sugar Land, TX (US)

( * ) Notice: Subject to any disclaimer, the term of this patent is extended or adjusted under 35 U.S.C. 154(b) by 0 days.

(21) Appl. No.: 09/500,877

(22) Filed: Feb. 9, 2000

Related U.S. Application Data

(60) Provisional application No. 60/119,231, filed on Feb. 9, 1999.

(51) Int. Cl.[7] ..... E21B 43/12
(52) U.S. Cl. ..... 166/305.1; 166/306; 166/205
(58) Field of Search ..... 166/51, 278, 157, 166/158, 305.1, 205, 334.4, 316, 306

(56) References Cited

U.S. PATENT DOCUMENTS

| | | | | |
|---|---|---|---|---|
| 3,195,633 | | 7/1965 | Jacob . | |
| 3,199,592 | | 8/1965 | Jacob . | |
| 3,627,046 | * | 12/1971 | Miller et al. | 166/51 X |
| 3,768,555 | | 10/1973 | Levens . | |
| 3,873,238 | | 3/1975 | Elfarr . | |
| 4,044,832 | * | 8/1977 | Richard et al. | 166/278 |
| 4,423,782 | | 1/1984 | Bowyer . | |
| 4,635,725 | * | 1/1987 | Burroughs | 166/278 |
| 4,932,474 | * | 6/1990 | Schroeder, Jr. et al. | 166/278 |
| 5,127,457 | * | 7/1992 | Stewart et al. | 166/306 |
| 5,133,407 | | 7/1992 | Deines et al. . | |

FOREIGN PATENT DOCUMENTS

| | | | |
|---|---|---|---|
| 000486976 A | * | 5/1992 | (EP) . |
| 2066324 | * | 7/1981 | (GB) . |
| 092016717 A | * | 10/1992 | (WO) . |

* cited by examiner

*Primary Examiner*—Frank Tsay
(74) *Attorney, Agent, or Firm*—Trop, Pruner & Hu PC

(57) ABSTRACT

A system for use in a wellbore includes a tubing having an inner bore and flow switcher assembly. The flow switcher assembly including a first conduit coaxial with the tubing inner bore and a second conduit formed annularly around the first conduit. One of the first and second conduits is adapted to carry production fluid flow, and the other one of the first and second conduits is adapted to carry injection fluid flow. The flow switcher assembly includes ports in communication with the first and second conduits to enable cross-over flow. In addition, one or more valves may be provided to control fluid flow through the ports.

31 Claims, 10 Drawing Sheets

COMPLETION EQUIPMENT HAVING A PLURALITY OF FLUID PATHS FOR USE IN A WELL

This application claims priority under 35 U.S.C. §119(e) to U.S. Provisional Application Serial No. 60/119,231, entitled "Completion Equipment having a Plurality of Fluid Paths for Use in a Well," filed Feb. 9, 1999.

BACKGROUND

The invention relates to completion of wells including completing a well with plural fluid flow paths, such as paths for concurrent injection and production of well fluids.

A completion string positioned in a well to produce fluids from one or more downhole formation zones may include casing, production tubing, packers, valves, pumps, and other components. One or more well sections may be perforated using a perforating gun string to create openings in the casing and to extend perforations into one or more corresponding formation zones. Fluid flows from the one or more formation zones through the perforations and casing openings into the wellbore and up the production tubing to the surface.

In some wells, simultaneous production and injection may be employed for a number of reasons. For example, it may be desirable to inject fluid into a first zone to increase reservoir pressure in a second zone to enhance the productivity of the second zone reservoir. Conventionally, simultaneous production and injection may be accomplished with a cross-flow packer that provides two flow paths, one for production and one for injection. The cross-flow packer isolates two sections of the wellbore, an upper section above the packer and a lower section below the packer. In the upper section, injection fluid may be pumped through the annular cavity between the outer wall of the production tubing and the inner wall of the casing, and production fluid is produced through the inner bore of the tubing. The cross-over packer allows the two fluid flows (one for injection and the other for production) to "cross over" at the packer between the tubing-casing annular cavity and the tubing inner bore.

However, use of conventional cross-flow packers may be associated with several limitations. Shut-off of the cross-over ports in the cross-over packer may not be available. As a result, cross-flow of fluids between the injection and production zones may occur during intervention, completion, and work-over operations. In addition, to perform operations in which access below the cross-over packer is needed, the cross-over packer may have to be milled to gain access. Furthermore, flow areas through the cross-over packer for injection and production fluid flows may be limited.

A need thus exists for improved equipment that provides multiple fluid paths, including cross-over paths.

SUMMARY

In general, according to one embodiment, a system for use in a wellbore includes a tubing having an inner bore and flow switcher assembly. The flow switcher assembly includes a first conduit coaxial with the tubing inner bore and a second conduit formed annularly around the first conduit. One of the first and second conduits is adapted to carry production fluid flow, and the other one of the first and second conduits is adapted to carry injection fluid flow.

Other features and embodiments will become apparent from the following description, the drawings, and the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

As used here, the terms "up" and "down"; "upper" and "lower"; "upwardly" and downwardly"; "above" and "below"; and other like terms indicating relative positions above or below a given point or element are used in this description to more clearly describe some embodiments of the invention. However, when applied to equipment and methods for use in wells that are deviated or horizontal, such terms may refer to a left to right, right to left, or other relationship as appropriate.

Figure 1:
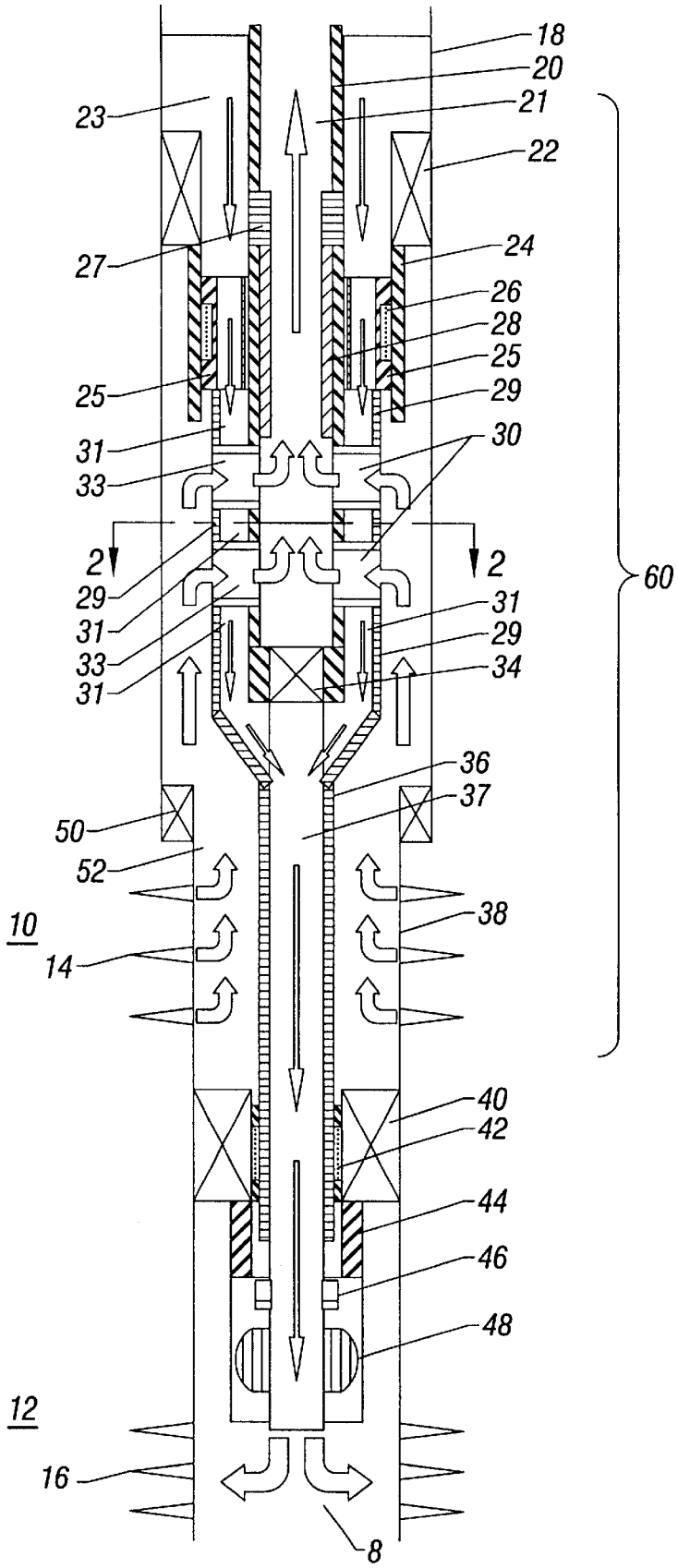
FIG. 1 illustrates an embodiment of a downhole string that provides injection and completion paths.

Referring to FIG. 1, a downhole string according to one embodiment for use with formation zones 10 and 12 includes a flow switcher assembly 60 having two flow paths, one for injection fluids and the other for production fluids. In the illustrated embodiment, fluid is injected into formation zone 12 through perforations 16, and fluid is produced from formation zone 10 through perforations 14. Injection of fluids into the injection zone 12 raises the pressure in the reservoir of the production zone 10 to enhance productivity of the production zone 10. The downhole string includes casing 18 that lines the inner wall of an upper section of a wellbore 8 and a liner 38 that lines a lower section of the wellbore 8. The casing 18 and liner 38 are sealably attached by a packer 50. Alternatively, the casing 18 may extend also to the lower zone 12 (with the liner 38 omitted).

In another arrangement, the injection and production zones 12 and 10 may be switched. Also, in further arrangements with more than two zones (e.g., more than one production and/or injection zone), additional injection and/or production fluid flow paths may be provided through the flow switcher assembly 60.

The flow switcher assembly 60 includes a first tubing or pipe 20 that is positioned in the wellbore 8 and includes an inner bore 21 through which production fluids may flow to the surface. As used here, the term "tubing" or "pipe" generally refers to any fluid flow conduit, channel, or path. An upper annular region 23 is defined between the outer wall of the tubing 20 and the inner wall of the casing 18 through which injection fluids may be pumped from the surface. A packer 22 is adapted to isolate the upper annular region 23 from the section of the wellbore 8 below the packer 22. A seal bore tubular extension 24 extends below the packer 22.

A seal assembly housing 25 mounted between the outer wall of the tubing 20 and the inner wall of the tubular extension 24 includes a seal element 26 (including packing elements for example). The seal assembly housing 25 and the tubing 20 define an annular bore through which injection fluid may flow from the upper annular region 23 above. The seal element 26 isolates the injection fluid and production fluid paths.

In addition, the fluid switcher assembly 60 includes a second tubing 29 having a diameter greater than that of the first tubing 20 that is attached below the seal assembly housing 25. The first and second tubings 20 and 29 may be generally concentrically arranged. An annular region 31 between the outer wall of the first tubing 20 and the inner wall of the second tubing 29 provides a path that continues from the annular region 23 and seal assembly housing 25 annular bore for injection fluids.

The flow switcher assembly 60 also includes a cross-over assembly 30 that is attached to the first and second tubings 20 and 29 and includes ports to direct injection and production fluid flows to their proper paths. As illustrated, the second tubing 29 is narrowed below the bottom of the first tubing 20 to form a tail tubing section 36. Injection fluid flows from the annular region 31 into the inner bore 37 of the tail tubing section 36.

A retrievable plug 34 is attached at the lower end of the tubing 20 to block communication between the tubing bore 21 and the bore 37 of the tail tubing section 36. The tail tubing section 36 directs injection fluid flow through a formation isolation valve assembly 48 (shown in the open position) and directed into a wellbore portion adjacent the perforations 16 of the formation zone 12. To isolate the formation zone 12, the formation isolation valve assembly 48 may be closed to block fluid flow between the tail tubing section 36 and the formation zone 12.

A packer 40 and a seal element 42 between the packer 40 and the outer wall of the tail tubing section 36 seals the formation zone 12 from the formation zone 10. A seal bore tubular extension 44 is attached below the packer 42 and is attached to the formation isolation assembly 48.

The production fluid flow path includes the inner bore 21 of the first tubing 20, conduits in the cross-over assembly 30, and a lower annular region 52 formed between the outer wall of the tail tubing section 36 and the outer wall of the liner 38. Production fluids flow from the formation zone 10 into the annular region 52, through the cross-over assembly 30, and up the inner bore 21 of the first tubing 20.

Figure 2:
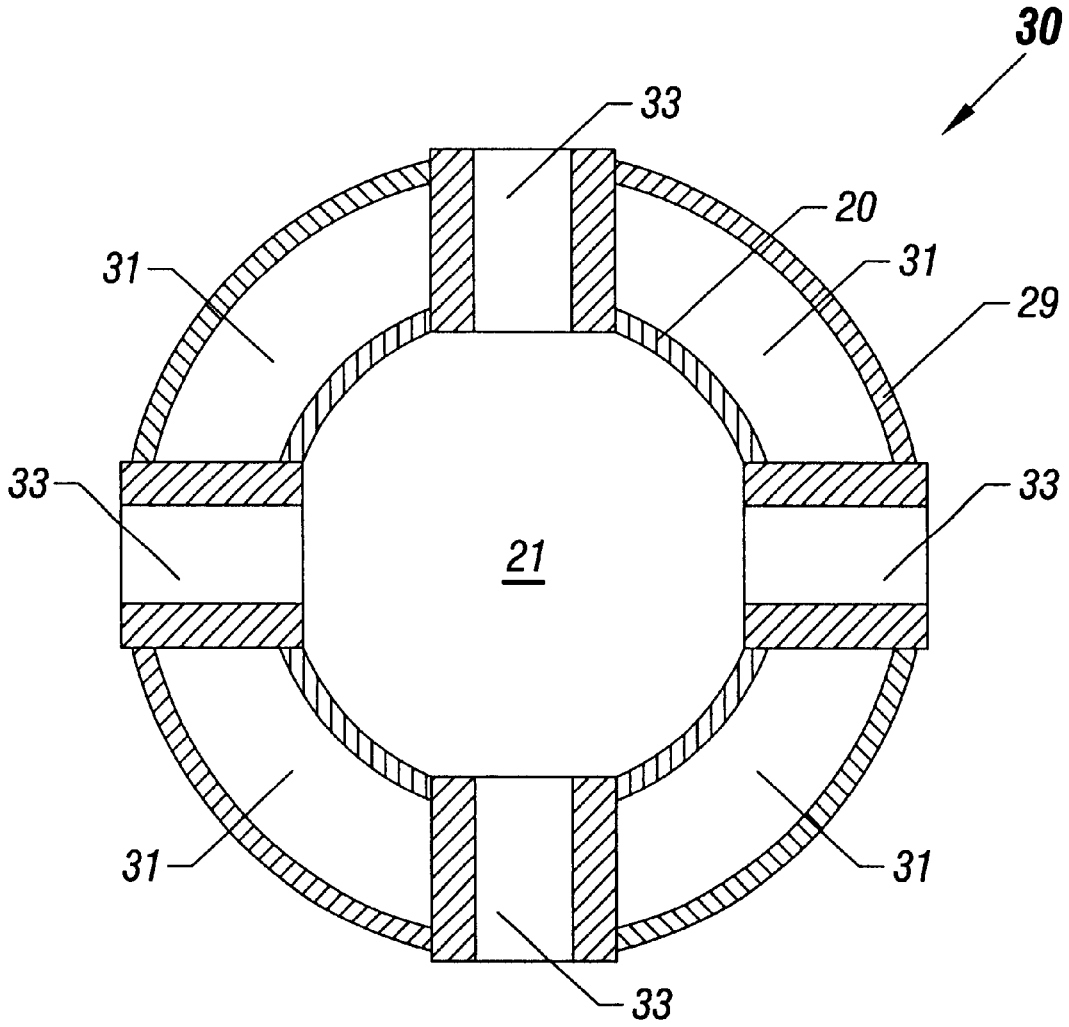
FIG. 2 illustrates cross-over assembly according to one embodiment that is part of the downhole string of FIG. 1.

Referring further to FIG. 2, a cross-section of the cross-over assembly 30 shows the annular paths 31 between the first and second tubings 20 and 29 through which injection fluids may flow. In addition, to allow production fluid flow from the annular region 52 to the inner bore 21 of the first tubing 20, flow tubes having ports or conduits 33 may be sealably attached (e.g., welded) through openings in the side walls of the first and second tubings. Alternatively, an integral component may be employed to provide the desired cross-over conduits 31 and 33. According to some embodiments, the flow area for the injection fluids and production fluids may be larger than available with conventional cross-over packers. In cross-over assembly may be able to provide flow paths that provide for substantially full bore flow. As used here, "full bore flow" refers to a flow area that is equivalent to the flow area of a main tubing (such as a production tubing).

Referring again to FIG. 1, a sliding sleeve valve assembly 28 may be mounted inside the first tubing 20 to control fluid production from the formation zone 10. The sliding sleeve valve assembly 28 may be actuated up or down to cover conduits 33 in the cross-over assembly 30 by a valve actuator 27. The valve actuator 27 may be controlled electrically, mechanically, by fluid pressure, or by fluid pressure pulse signals. In the closed position, the sleeve valve 28 blocks fluid flow from flowing through the conduits 33 into the inner bore 21 of the first tubing 20 to isolate the production zone 10. In further embodiments, instead of the sleeve valve 28, disk valves may be used instead. Examples of disk valves are disclosed in U.S. patent application Ser. No. 09/243,401, entitled "Valves for Use in Wells," filed Feb. 1, 1999, and hereby incorporated by reference.

The apparatus shown in FIG. 1 providing for simultaneous injection and production fluid flow channels also includes a bore in the cross-over assembly 30 through which a tool string can be run. Thus, if intervention is desired in a work-over operation, the retrievable plug 34 can be removed and the tool string run through the inner bores of the tubing 20 and the cross-over assembly 30 to a desired location. In addition, the cross-over assembly 30 also includes a flow control device (in the form of the sleeve valve 28) that can be actuated to the closed position to block fluid flow through ports in the cross-over assembly 30. This provides fluid isolation during work-over operations.

In operation, according to one embodiment, a perforating gun string may be lowered into the wellbore 8 to perforate the lower zone 12. The perforated lower zone 12 can then be killed and the gun string pulled out of the wellbore 8. Next, the packer 40 and formation isolation valve assembly 48 (along with associated equipment) may be lowered on a cable or work string into the wellbore 8 with the formation isolation valve in the closed position. The packer 40 can then be set to isolate the lower zone 12 from the upper zone 10.

An alternative way of perforating the lower zone 12 includes first running the packer 40 and the formation isolation valve 48 into the wellbore 8 and setting the packer 40 before running a perforating gun string down. The packer 40 may be set by hydraulic pressure applied through a tubing, electrically by a cable, or by other activation mechanisms. Next, a perforating gun string with a shifting tool attached may be lowered into the wellbore 8. The shifting tool is adapted to open the formation isolation valve assembly 48 to allow the gun string to pass through. After perforation, the gun string may be removed with the shifting tool used to close the formation isolation valve assembly 48. In this embodiment, the lower zone 12 does not need to be killed after perforation as the formation isolation valve assembly 48 may be closed to isolate the lower zone 12.

After perforation of the lower zone 12, the upper packer 22 may be run on a wireline or by other carrier mechanism into the wellbore 8. After the packer 22 is set, a perforating gun string may be run into the wellbore 8 to perforate the upper formation zone 10. The upper zone 10 is then killed and the perforating gun string is removed from the wellbore 8. Next, the remainder of the downhole string may be run into the wellbore and mounted into the packers 22 and 40. To open the formation isolation valve assembly 48, a pressure cycle having a pressure pulse of a predetermined magnitude may be applied down the annular region 23 between the first tubing 20 and the casing 18, which is communicated into the tail tubing section 36 to operate the formation isolation valve assembly 48. This allows the fluid injection and production process to start.

The flow switcher assembly 60 according to some embodiments allows work-over intervention to be performed. To perform intervention of the lower zone 12, the sliding sleeve valve 28 may be closed, such as with a shifting tool to isolate the upper zone 10. Next, the plug 34 is removed to open up the inner bore 21 of the first tubing 20 to the inner bore 37 of the tail tubing section 36. This allows an intervention string to be lowered down the first tubing 20 and into the tail tubing section 36 to perform intervention on the lower zone 12. After intervention is completed, the string is pulled out of the wellbore 8 and the plug 34 run back into the first tubing 20 for re-mounting. The sliding sleeve valve 28 may then be opened for further production.

Intervention may also be performed on the upper zone 10. The sliding sleeve valve 28 is closed to isolate the upper zone 10. The plug 34 is removed, and a shifting tool may be run down the first tubing 20 and the tail tubing section 36 to close the formation isolation valve assembly 48. A portion of the downhole string may then be pulled out of the wellbore 8 to allow the producing zone 10 to be worked over. After work-over operations have been completed, the removed downhole string portion may be run back into the wellbore 8 and placed back in position. A shifting tool may then be run down the first tubing 20 and the tail tubing section 36 to open the formation isolation assembly 48. Next, the plug 34 is run back down and put in place. The sleeve valve 28 can then be opened to resume production and injection.

Some embodiments of the invention may have one or more of the following advantages. The flow switcher assembly 60 may be relatively low cost. Further, relatively large flow areas may be provided for both the production and injection flow paths. The number of trips employed to complete a well including plural injection and production flow paths may be reduced. Independent mechanisms allow different zones to be isolated to prevent cross flow of injection and production fluids during work-over operations. Existing packers may be used in the completion equipment according to some embodiments, and these packers do not need to be milled for work-over operations.

Figure 3A:
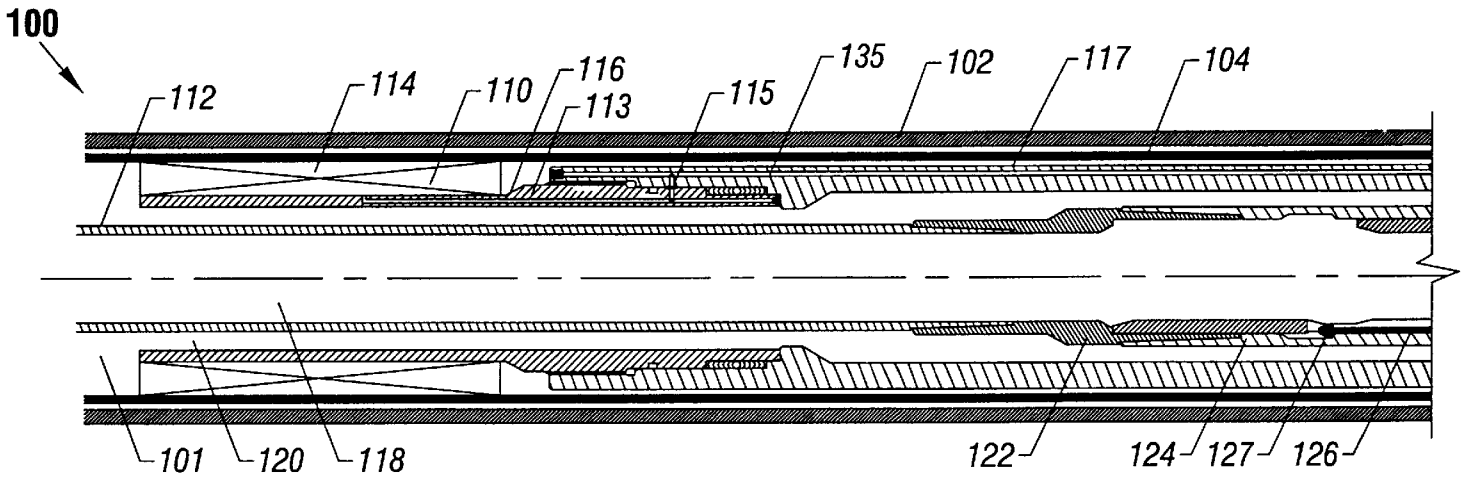
FIGS. 3A–3H are longitudinal sectional views of a downhole string providing injection and production fluid flow paths in accordance with another embodiment.
Figure 4A:
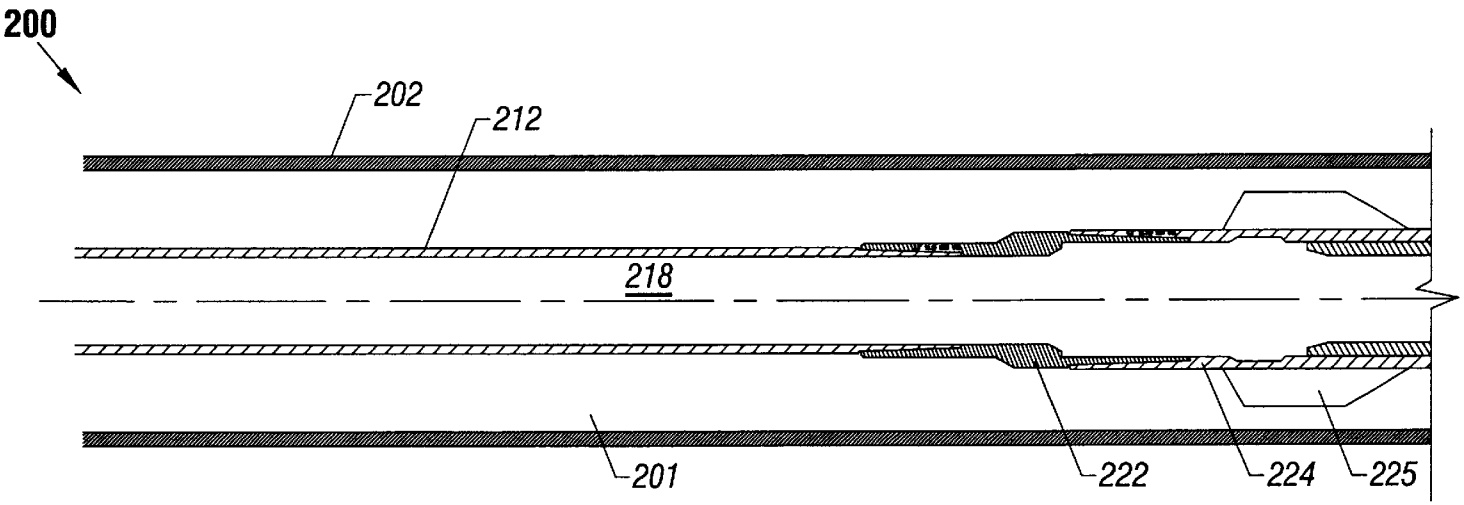
FIGS. 4A–4E are longitudinal sectional views of a downhole string providing injection and production fluid flow paths in accordance with a further embodiment.
Figure 3B:
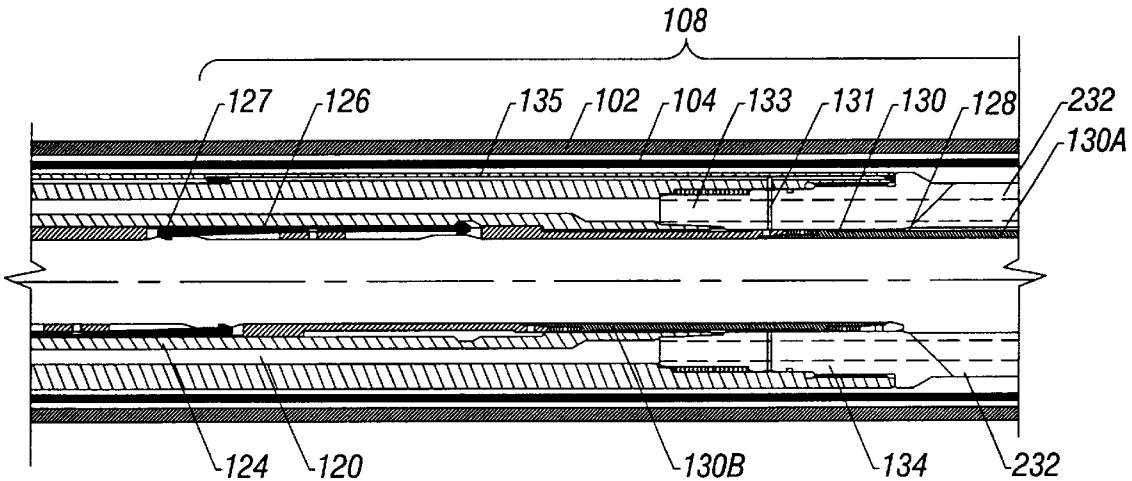
Figure 4B:
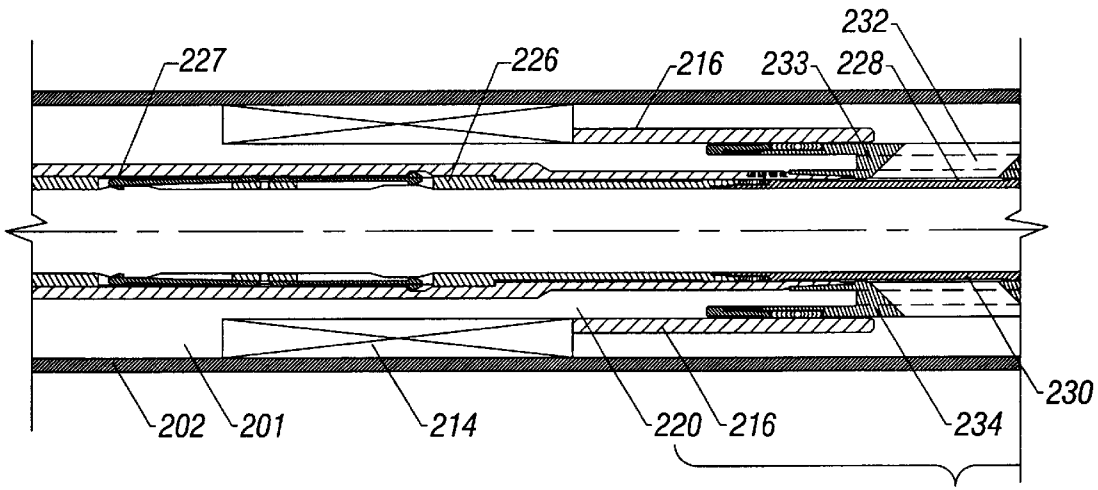
Figure 3C:
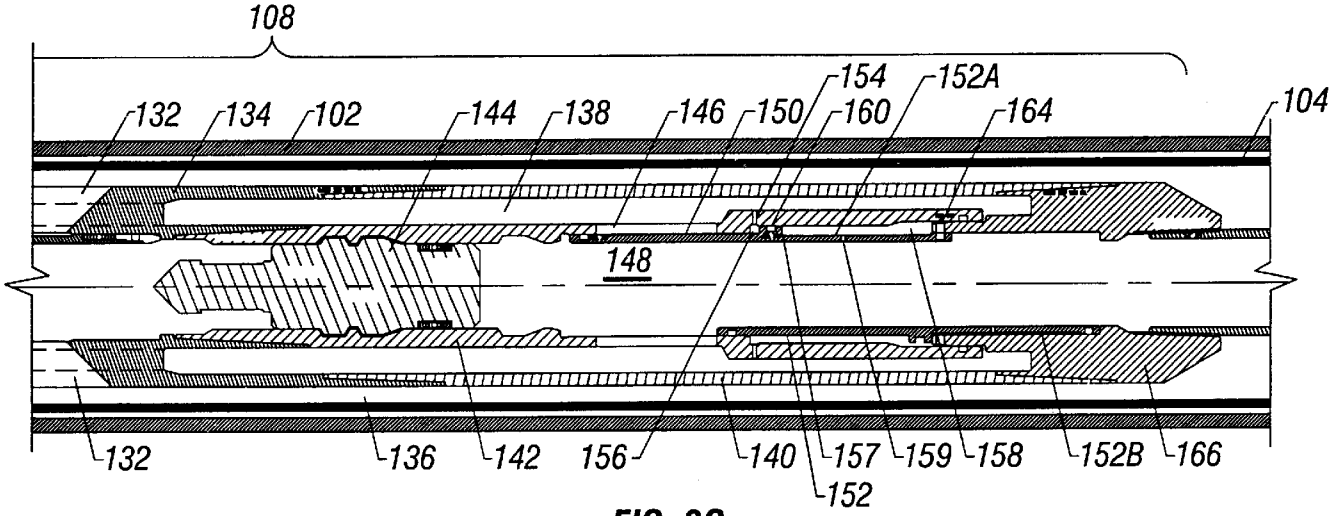
Figure 4C:
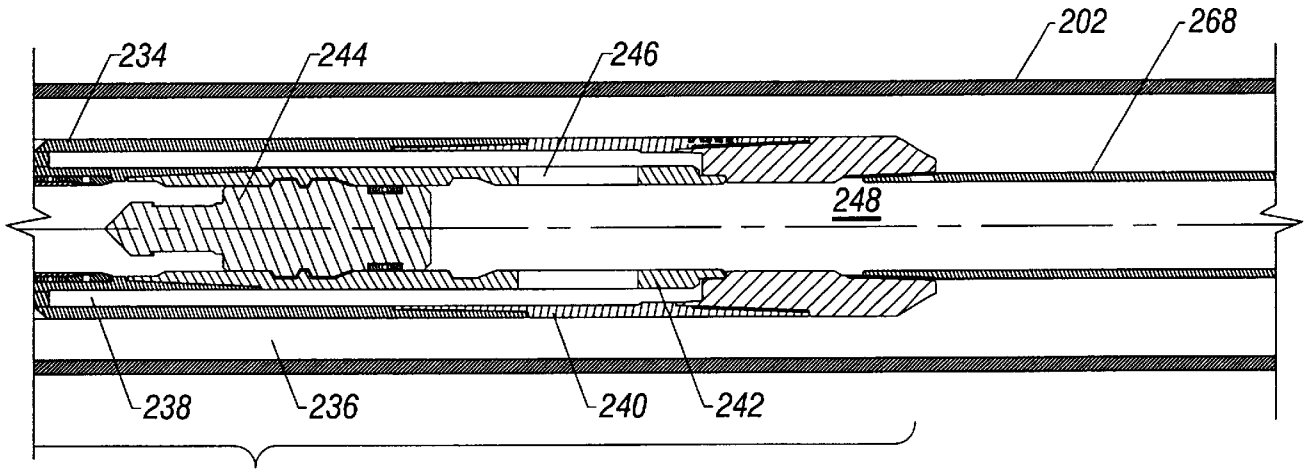
Figure 3D:
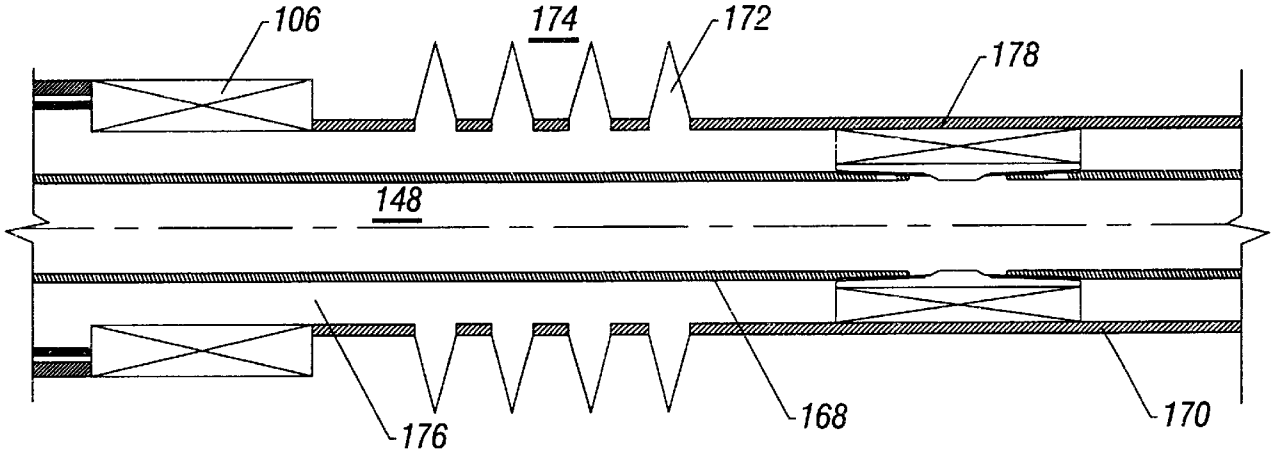
Figure 4D:
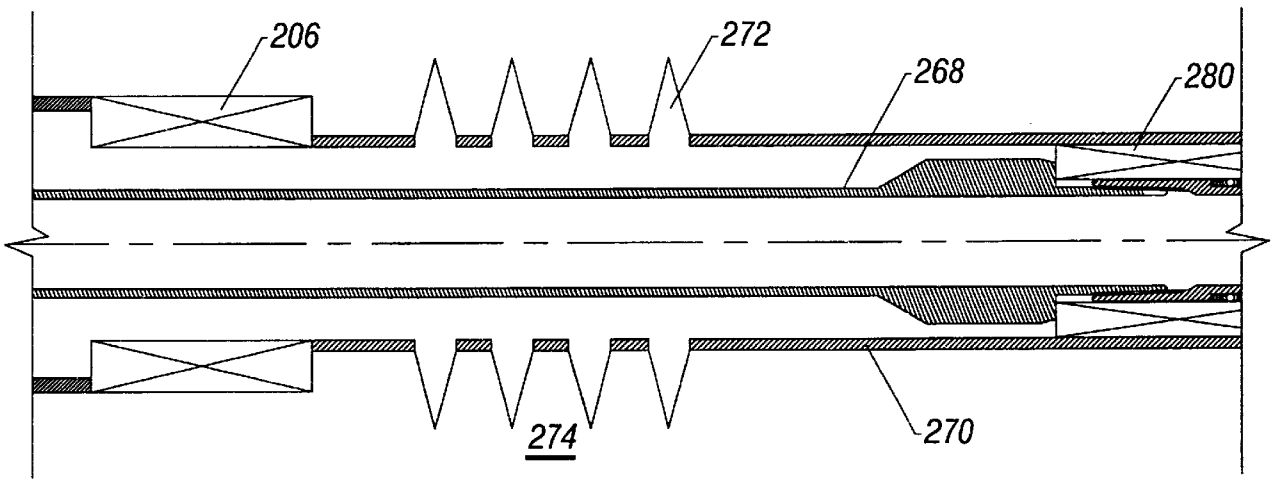
Figure 3E:
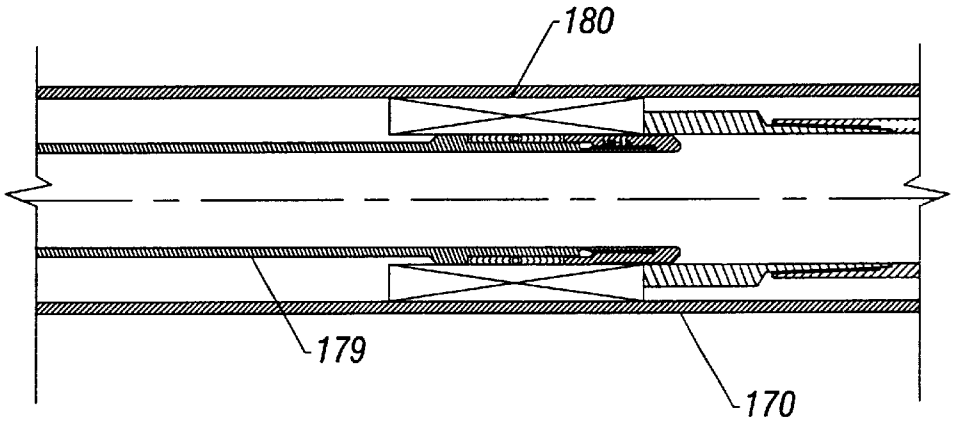
Figure 4E:
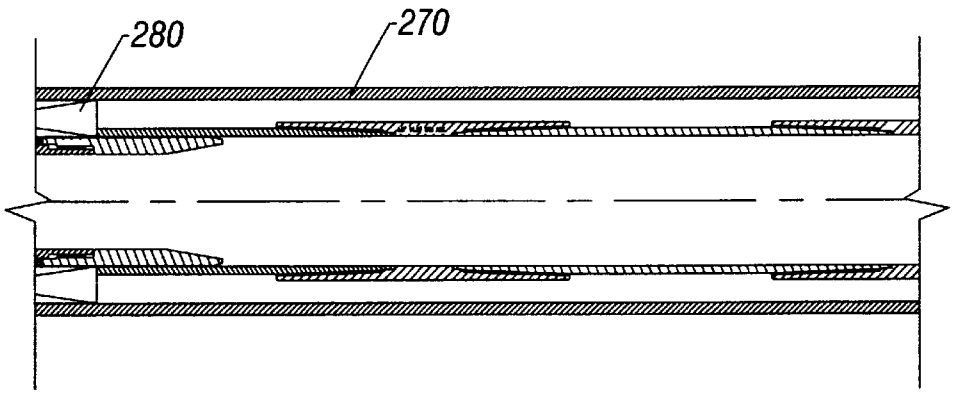
Figure 3F:
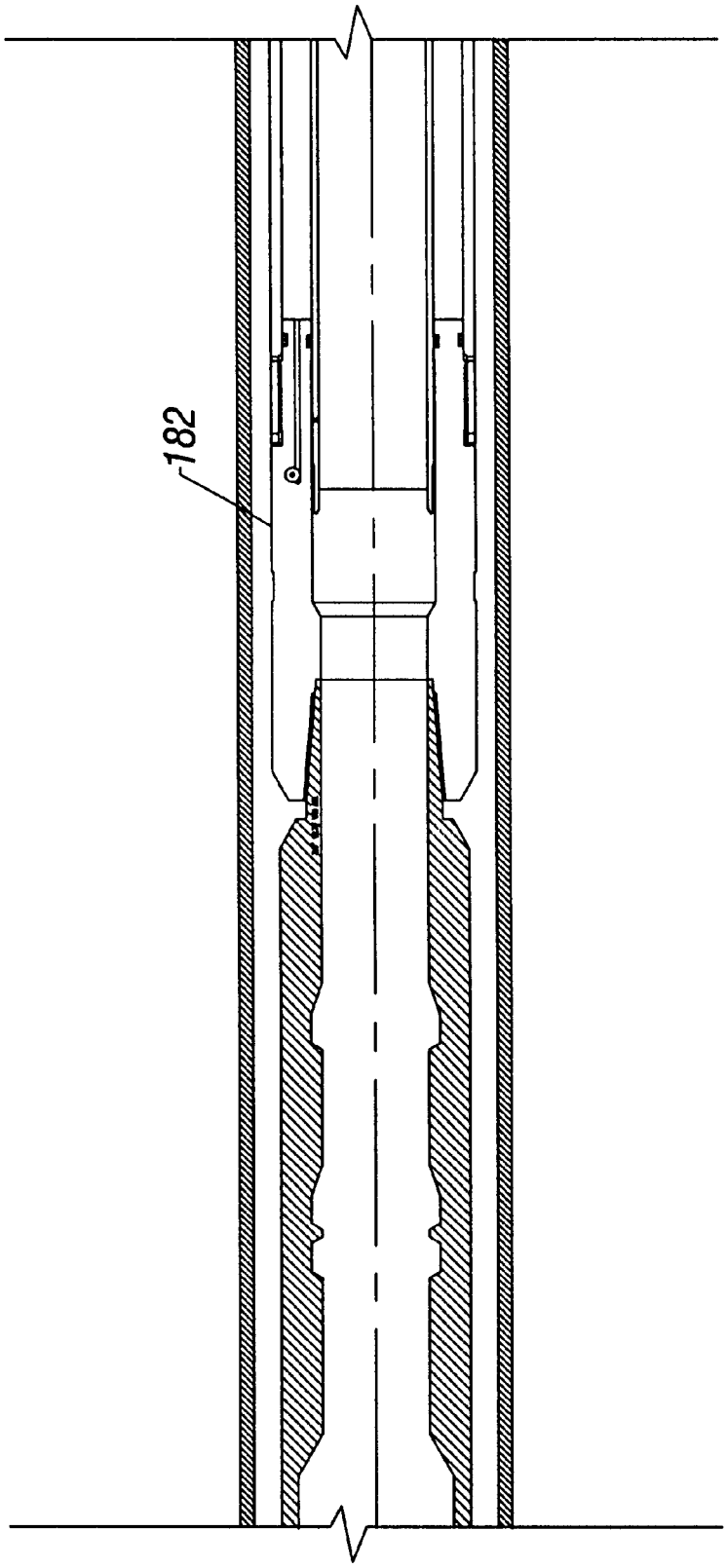
Figure 3G:
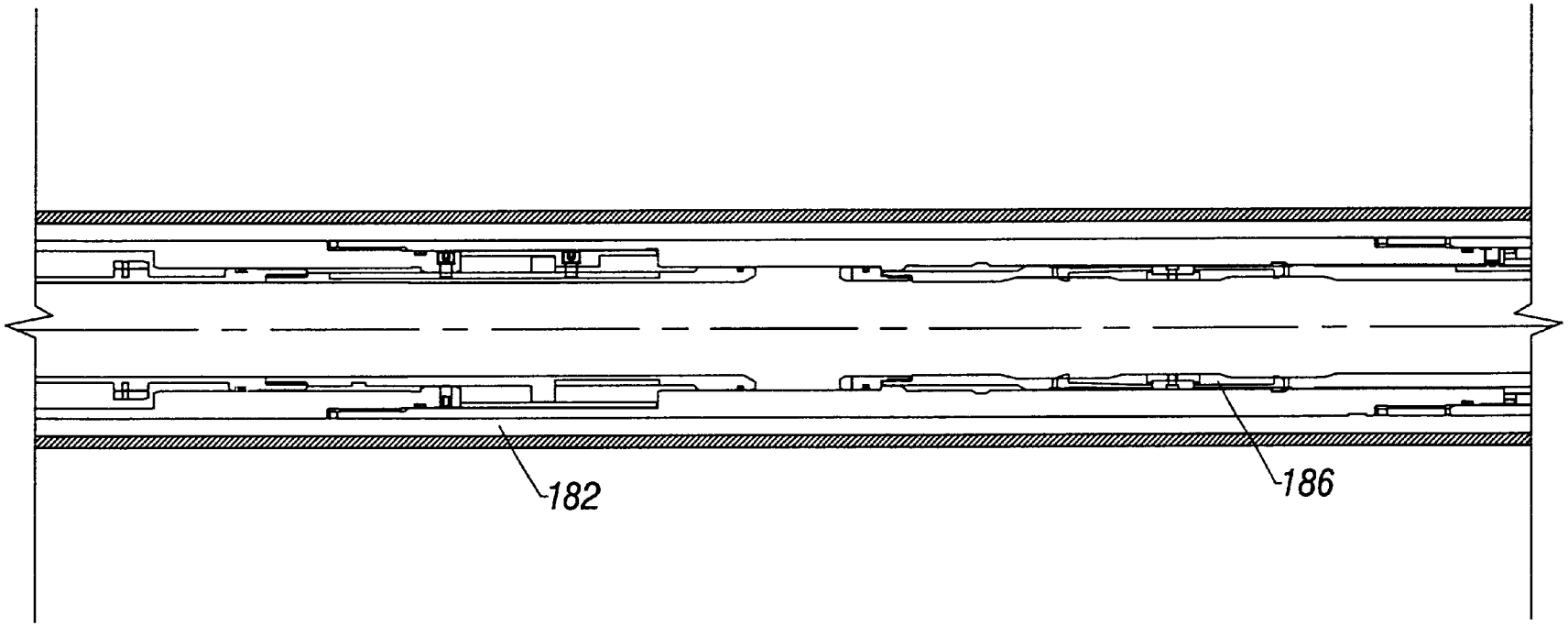

Referring to FIGS. 3A–3H, a downhole string 100 in accordance with an alternative embodiment is illustrated. The downhole string 100 includes a casing section 102 as well as a polished bore receptacle 104 positioned inside the casing 102 and extending from a packer 106 (FIG. 3D). In an alternative embodiment, the polished bore receptacle 104 may be omitted. The downhole string 100 also includes a flow switcher assembly 108 (FIGS. 3B–3C) that provides ports or conduits to allow injection and production fluid paths to cross-over.

As shown in FIG. 3A, a main production tubing 112 extends through a packer assembly 114 that includes a sealing element 110 and a packer mandrel 116. The packer mandrel 116 is attached to a housing 117. The tubing 112 has an inner bore 118 that provides a flow path. In addition, a flow path 120 is provided between the outside of the tubing 112 and the inside of the housing 117. The lower end of the tubing 112 is connected through a connector 122 to a pipe section 124. Inside the pipe section 124 is arranged an operator 126 for a sleeve valve 128, which includes a sleeve 130. The operator 126 includes a latch 127 adapted to engage a shifting tool run in the inner bore 118 of the tubing 112. For purposes of illustration, the sleeve is shown in two separate portions 130A and 130B, with the sleeve portion 130A covering radial ports 132 (corresponding to the closed position of the sleeve 130), and the sleeve portion 130B positioned above the ports 132 (corresponding to the open position of the sleeve valve 28). In further embodiments, instead of the sleeve valve 128, disk valves may be used instead.

The radial ports 132 are part of a cross-over assembly 134 that enable cross-over of the injection and production fluid paths. The arrangement of the cross-over assembly 134 is similar to that shown in FIG. 2, but instead of welded pieces as shown in FIG. 2, the cross-over assembly 134 is formed from a single housing. The radial ports 132 enable communication between the inner bore of the tubing 112 and an annulus region 136 between the polished bore receptacle 104 and the outside of the cross-over assembly 134 housing. In addition, the cross-over assembly 134 housing defines longitudinal ports or conduits 133 to allow communication between the annular path 120 and a lower annular path 138 below the cross-over assembly 134.

A port 131 (FIG. 3B) allows communication between the inner bore 118 and a channel 135 extending longitudinally in the housing 117. The channel 135 leads to a port 115 (FIG. 3A) that in turn leads to a channel 113 in the packer mandrel 116. The channel 113 leads to the packer 114. The port 131, channel 135, port 115, and channel 113 provide a fluid communication path to enable inner bore 118 pressure to set the packer 114.

The upper end of the cross-over assembly 134 is connected to the lower ends of both the pipe section 124 and the housing 117. The lower end of the cross-over assembly 134 is connected to an outer pipe section 140 as well as an inner pipe section 142. The inner wall of the pipe section 142 provides a profile in which a plug 144 can be connected. Such a profile may be a threaded profile, for example. The plug 144 may be lowered through the inner bore 118 of the tubing 112 for attachment to the pipe section 142.

The pipe section 142 also defines radial flow ports 146 that enable communication between the annular path 138 and the inner bore 148 of the pipe section 142. Flow through the radial flow ports 146 are controlled by a sliding sleeve valve 150 that has a moveable sleeve 152. For illustration purposes, the sleeve 152 is broken into two portions 152A and 152B. The sleeve portion 152A is shown in its closed position in which it covers the ports 150. The sleeve portion 152B is shown in its open position.

One or more flow ports 154 communicates fluid pressure between the annular path 138 and a chamber 156. The chamber 156 is in communication with an outwardly extending flange portion 157 of the sliding sleeve 152. The flange portion 157 carries a seal 160 to isolate the chamber 156 from a chamber 162, which is in communication with the inner bore 148. Thus, a pressure applied down the annular path 138 (such as due to injection fluid flow) is communicated through the chamber 156 to move the sliding sleeve 152 downwardly. The sliding sleeve 152 is connected to an adapter 166 by a shear pin 164 (or some other type of one or more shear members).

The lower ends of the pipe sections 140 and 142 are connected to the adapter 166, which in turn is connected to a tubing 168. The tubing 168 includes a bore that is in communication with the bore 148 of the pipe section 142. The tubing 168 extends inside a liner 170. Perforations 172 are formed in the liner 170 below the packer 106 to enable fluid flow from a zone 174 (e.g., a production zone) into an annular region 176 between the liner 170 and the tubing 168. The annular region 176 is in communication with the annular region 136 above the packer 106.

Plural packer assemblies 178 and 180 may be positioned below the zone 174. A packer mandrel 179 in the packer assembly 178 is inserted into the inner bore of the packer assembly 180. In other embodiments, the number of packer assemblies may be increased or decreased as desired. Connected below the packer assembly 180 is an isolation valve assembly 182, which includes a ball valve 184 operably connected to a valve operator 186. The valve operator 186 includes an inner profile adapted to be engaged by a shifting tool to operate the ball valve 184 between an open position and a closed position.

The isolation valve assembly 182 includes an inner bore 188 that communicates through the ball valve 184 to a wellbore section 190 below the isolation valve assembly 182. The liner 170 in the region 190 is perforated to enable fluid communication between the bore section 190 and zone 192 (which can be the injection zone).

Figure 3H:
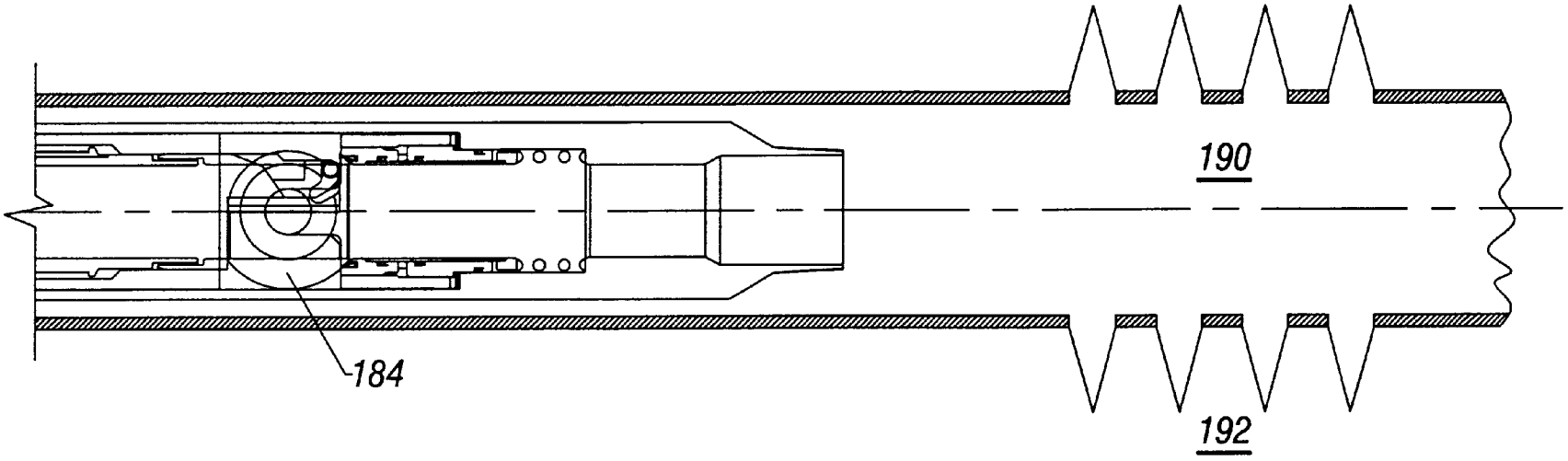

Once the packer assembly 180 (FIG. 3E) has been set and a string including the packer assembly 178 and the flow switcher assembly 108 is stabbed into the packer assembly 180, a pressure can be communicated through the inner bore 118 of the upper tubing 112 and the inner bore 148 of the lower tubing 168 to set the packer assembly 178. During run in of the string, the plug 144 is not present to enable fluid communication between the inner bores 118 and 148. The inner surface of the packer assembly 178 is in communication with pressure inside the inner bore 148. The inner bore 148 pressure is applied against a closed ball valve 184 (FIG. 3H). In addition, the sleeve valves 128 and 152 of the flow switcher assembly 108 are closed to enable pressure buildup inside the bores 118 and 148 to set the packer 178.

The same pressure may be used to set the upper packer 114 (FIG. 3A). The inner bore 118 pressure is communicated through the port 131 (FIG. 3B), up the channel 135, through the port 115, and up the channel 113 to the packer assembly 114. Thus, the flow control devices (including sleeve valves 128 and 152) enable blockage of fluid communication between inner bores of the string and the outside of the string to enable inner bore pressure to set packers.

Referring to FIGS. 4A–4E, a downhole string 200 in accordance with another embodiment is illustrated. The downhole string 200 also includes a flow switcher assembly 208 that provides cross-over paths for the injection and production flows. The downhole string 200 includes a casing section 202 that terminates at a packer 206. A liner 270 is connected below the packer 206. A main tubing 212 may be provided inside the casing 202. The lower end of the tubing 212 is connected to a pipe section 224 through a connector 222. Centralizers 225 may be provided outside the pipe section 224.

A valve operator 226 is arranged inside the pipe section 224 and includes a latch 227 adapted to be engaged by a shifting tool run in the inner bore 218 of the tubing 212. The valve operator 226 is connected to a valve assembly 228 that includes a sleeve valve 230. Alternatively, disk valves may be employed. As illustrated, the sleeve valve 230 is in its closed position in which its covers radial flow ports 232 formed in a cross-over assembly 234.

The upper end of the cross-over assembly 234 is connected to a packer bore extension 216 and to the lower end of the pipe section 224. The lower end of the cross-over assembly 234 is connected to pipe sections 240 and 242 (pipe section 242 arranged concentrically inside the pipe section 240). The inner surface of the pipe section 242 includes a profile to which a plug 244 can be attached. The pipe section 242 also provides radial flow ports 246.

The flow paths provided in the downhole string 200 includes the inner bore 218 of the tubing 212 as well as an annular region 201 between the tubing 212 and the casing 202. The annular region 201 leads to an annular region 220 between the packer bore extension 216 and the pipe section 224. The annular path 220 communicates through longitudinal ports or conduits 233 that enable communication between the path 220 and an annular path 238.

The radial ports 230 in the cross-over assembly 234 enable communication between the inner bore 218 and an annular region 236 outside the housing of the cross-over assembly 234. The outside annular region 236 communicates with an annular region 276 below the packer 206 that leads to a production zone 274 through perforations 272.

The injection flow ports 246 enable communication between the annular path 238 and the inner bore 248 of the pipe section 242. The inner bore 248 leads into the bore of the tubing 268. The lower end of the tubing 268 is connected to a packer assembly 280 that in turn is coupled to an isolation valve assembly similar to valve assembly 182 in FIGS. 3G–3H.

While the invention has been disclosed with respect to a limited number of embodiments, those skilled in the art will appreciate numerous modifications and variations therefrom. It is intended that the appended claims cover all such modifications and variations as fall within the true spirit and scope of the invention.

What is claimed is:

1. A system for use in a wellbore, comprising:

a tubing having an inner bore;

a flow switcher assembly including:

a first conduit coaxial with the tubing inner bore, and a second conduit formed annularly around the first conduit, one of the first and second conduits adapted to carry production fluid flow and the other one of the first and second conduits adapted to carry injection fluid flow; and a retrievable plug attached in the first conduit.

2. The system of claim 1, wherein the first conduit is sized to receive a tool string lowered through the tubing inner bore.

3. The system of claim 2, wherein the retrievable plug is adapted to be removed to enable a tool string to pass through the flow switcher assembly.

4. A system for use in a wellbore, comprising:

a tubing having an inner bore;

a flow switcher assembly including:

a first conduit coaxial with the tubing inner bore, and a second conduit formed annularly around the first conduit, one of the first and second conduits adapted to carry production fluid flow and the other one of the first and second conduits adapted to carry injection fluid flow;

a pipe connected below the flow switcher assembly;

a first annular region outside the tubing above the flow switcher assembly; and a second annular region outside the pipe below the flow switcher assembly.

5. The system of claim 4, wherein the pipe includes an inner bore, and wherein the flow switcher assembly further includes ports to enable communication between the first conduit and the second annular region and to enable communication between the second conduit and the pipe inner bore.

6. The system of claim 5, wherein the first conduit and second annular region form at least part of a production flow path.

7. The system of claim 6, wherein the second conduit and the first annular path form at least part of an injection flow path.

8. The system of claim 5, wherein the flow switcher assembly further includes a first valve to control flow through one or more ports enabling communication between the first conduit and the second annular region.

9. The system of claim 8, wherein the flow switcher assembly further includes a second valve to control flow through one or more ports enabling communication between the second conduit and the first annular region.

10. The system of claim 9, wherein at least one of the first and second valves include sliding sleeves.

11. The system of claim 5, wherein the ports include a first set of one or more ports and a second set of one or more ports, and where in the flow switcher assembly further includes a valve to control flow through at least one of the first and second sets of one or more ports.

12. The system of claim 11, wherein the valve includes a sliding sleeve.

13. The system of claim 12, wherein the flow switcher assembly further includes first and second chambers, and the sliding sleeve is moveable by differential pressure between the first and second chambers.

14. The system of claim 13, further comprising a shear member fixedly attaching the sliding sleeve to the flow switcher assembly.

15. The system of claim 13, wherein the first chamber is in communication with the injection flow path, the first chamber adapted to increase in pressure in response to the injection fluid flow.

16. An apparatus for use in a wellbore having a plurality of zones, comprising:

a first pipe having a bore;

a second pipe having a bore through which the first pipe is passed through, an annular region defined between an outer wall of the first pipe and an inner wall of the second pipe to provide a first fluid path in communication with a first zone; and an assembly having a conduit sealably mounted through the first and second pipes to allow fluid communication between the first pipe bore and the outside of the second pipe to provide a second, separate fluid path in communication with another zone.

17. The apparatus of claim 16, wherein the assembly includes a flow conduit extending through side walls of the first and second pipes.

18. The apparatus of claim 17, further comprising a valve to control flow through the flow conduit.

19. The apparatus of claim 18, wherein the valve includes a sliding sleeve.

20. The apparatus of claim 16, wherein the first fluid path is adapted to receive injection fluids and the second fluid path is adapted to receive production fluids.

21. A method for use in a well having a plurality of zones, comprising:

injecting fluids through a first fluid path including an annular region between a first tubing and a second tubing, the fluid path being in communication with a first zone; and producing fluids through a second fluid path in communication with a second zone and including the inner bore of the first tubing, a region outside the second tubing, and a conduit member sealably mounted through side walls of the first and second tubings.

22. The method of claim 21, further comprising providing a cross-over assembly to enable communication of injection fluid between the annular region and a pipe leading to the first zone, and to enable communication of production fluid between the inner bore of the first tubing and an annular region outside the pipe leading to the second zone.

23. The method of claim 22, further comprising lowering a tool through the cross-over assembly to one of the first and second zones.

24. The method of claim 23, further comprising removing a plug in the first fluid path before lowering the tool.

25. The method of claim 22, wherein the cross-over assembly includes ports and one or more flow control devices to control communication through the ports, the method further comprising closing the one or more flow control devices to block communication through the ports to perform a work-over operation.

26. The method of claim 22, wherein the cross-over assembly includes ports and one or more flow control devices to control communication through the ports, the method further comprising closing the one or more flow control devices to block communication through the ports to enable pressure buildup in an inner bore of the cross-over assembly to set one or more packers.

27. The method of claim 26, further comprising closing a formation isolation valve to enable the pressure buildup in the inner bore.

28. The method of claim 22, further comprising removing an assembly including the cross-over assembly to perform a work-over operation.

29. A method of simultaneously providing injection and production fluids to or from a plurality of zones in a well, comprising:

injecting fluids through a first fluid path in communication with a first zone including an inner bore of a first tubing, a region outside a second tubing, and a conduit member sealably mounted through side walls of the first and second tubings; and producing fluids through a second fluid path including an annular region between the first tubing and the second tubing, the second fluid path being in communication with a second zone.

30. A system for use in a wellbore, comprising:

a tubing having an inner bore and defining a well annulus between the tubing and the wellbore; and a flow switcher including:

a flow switcher housing defining a first fluid path providing fluid communication between the inner bore and a first formation zone, and a second fluid path providing fluid communication between the inner bore and a second formation zone, and at least one flow control device to control flow through at least one of the first fluid path and the second fluid path.

31. A system for use in a wellbore, comprising:

a tubing having an inner bore and defining a well annulus between the tubing and the wellbore;

a flow switcher housing;

the flow switcher housing defining a first fluid path providing fluid communication between the inner bore and a first formation zone, the first fluid path providing substantially a full bore flow, and the flow switcher housing further defining a second fluid path providing fluid communication between the inner bore and a second formation zone, the second fluid path providing substantially a full bore flow.

* * * * *